US007356911B2

(12) United States Patent
Harada et al.

(10) Patent No.: US 7,356,911 B2
(45) **Date of Patent: *Apr. 15, 2008**

(54) METHOD FOR PRODUCING AN INSULATED WIRE

(75) Inventors: Toshinobu Harada, Tokyo (JP); Masaki Sugiura, Tokyo (JP); Satoshi Saitou, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/167,454

(22) Filed: Jun. 27, 2005

(65) Prior Publication Data

US 2005/0229391 A1 Oct. 20, 2005

Related U.S. Application Data

(62) Division of application No. 09/969,260, filed on Oct. 1, 2001, now Pat. No. 6,925,703.

(30) Foreign Application Priority Data

Oct. 3, 2000 (JP) ..... 2000-304235

(51) Int. Cl.
*H01F 7/06* (2006.01)

(52) U.S. Cl. ..... 29/605; 29/844; 29/851; 29/858; 29/885; 336/205; 336/208; 336/223; 427/117; 427/118; 427/119; 427/120

(58) Field of Classification Search ..... 29/605, 29/844, 851, 858, 885; 427/117–120; 118/44; 336/205, 208, 223
See application file for complete search history.

(56) References Cited

U.S. PATENT DOCUMENTS

| | | | | |
|---|---|---|---|---|
| 3,648,506 | A * | 3/1972 | Caltagirone | 72/206 |
| 4,109,375 | A | 8/1978 | Lin et al. | |
| 4,231,151 | A | 11/1980 | Haderer et al. | |
| 4,716,079 | A * | 12/1987 | Sano et al. | 428/383 |
| 5,105,531 | A * | 4/1992 | Sawada et al. | 29/605 |
| 6,216,513 | B1 | 4/2001 | Nakamura et al. | |
| 6,313,409 | B1 | 11/2001 | Bales, Jr. et al. | |
| 6,407,339 | B1 | 6/2002 | Rice et al. | |
| 6,553,650 | B2 * | 4/2003 | Nakamura et al. | 29/605 |

FOREIGN PATENT DOCUMENTS

| | | |
|---|---|---|
| EP | 0 120 154 | 10/1984 |
| JP | 62163544 A | 7/1987 |

OTHER PUBLICATIONS

"A new conductor insulation for high voltage coils"; Allison, J.A.; Electrical Electronics Insulation Conference, 1991. Boston '91 EEIC/ICWA Exposition., Proceedings of the 20th; Oct. 7-10, 1991; pp. 195-197.*

* cited by examiner

*Primary Examiner*—Paul D. Kim
(74) *Attorney, Agent, or Firm*—Knobbe Martens Olson & Bear LLP

(57) ABSTRACT

A method for producing an insulated wire having a cross section of a desired shape, in which a conductor having a cross section of a desired shape is coated with an insulating film, which method comprises: supplying a raw conductor while passing through a rolling unit composed of at least one pair of rolling rolls that are capable of freely rotating without a drive mechanism and that have a desired shape, thereby forming a conductor having a cross section of a desired shape; and coating the conductor with an insulating film.

12 Claims, 1 Drawing Sheet

METHOD FOR PRODUCING AN INSULATED WIRE

CROSS REFERENCE TO RELATED APPLICATIONS

This application is a divisional of U.S. application Ser. No. 09/969,260 filed Oct. 1, 2001, now U.S. Pat. No. 6,925,703.

FIELD

The present invention relates to a method for producing an insulated wire, in which an insulating film is formed on a conductor having a cross section of a desired shape.

BACKGROUND

According to a conventional production method for an insulated wire having a cross section of any shape other than round, it was hitherto difficult to continuously produce the insulated wire, beginning with feeding of a round wire raw conductor and ending with completing of the insulated wire as a final product. The reason for the difficulty is that the conventional production method needed two or more many steps, each having a different wire speed. The formation of a so-called rectangular wire, in which a conductor takes in the shape of rectangular, is explained, as an example, below. First, a round wire raw conductor is rolled, by means of a rolling mill, plural times, until the conductor becomes a determined size. The rolled conductor is once wound around a bobbin as layer winding. Thereafter, from the bobbin, the rectangular conductor is fed to an enameling machine, for annealing, enameling and winding, or the rectangular conductor is set in an extruder, to be coated with a resin. Thus, the conventional production method needed at least two steps, such as the rolling step, and the enameling or extrusion step. These two steps are considerably different from each other in wire speed capable of being processed in each step. Therefore, it was hitherto difficult to continuously carry out all steps in the conventional production method for insulated wire.

As mentioned above, the conventional production method for insulated wire needed two or more steps, each having a different wire speed. As a result, the following problems arose:

(i) Both the rolling step and the insulation-coating step must be separated, which results in greater cost.

(ii) Plural steps are needed, which results in long lead time.

(iii) The rolling is successively carried out in the thickness direction and in the width direction, so that dimensional precision of the final thickness, width, and corner radius (R) is not high.

(iv) The winding and the feeding, such as the winding after rolling and the feeding to the resin-coating step, are repeated, such that the surface of the conductor is apt to become scratched, which results in deterioration of the surface quality.

(v) The drawing may be conducted by a drawing die after rolling by driven rolls. However, elongation (stretching) in both the longitudinal direction and the width direction is not definite, so that any means, such as a tension-controlling apparatus, is needed, to make addition to a driving system of each roll, which results in a sharp increase in the cost of equipment.

SUMMARY

The present invention is a method for producing an insulated wire having a cross section of a desired shape, in which a conductor having a cross section of a desired shape is coated with an insulating film, comprising the steps of: supplying a raw conductor while passing through a rolling unit composed of at least one pair of rolling rolls that are capable of freely rotating without a drive mechanism and that have a desired shape, thereby forming a conductor having a cross section of a desired shape; and coating the conductor with an insulating film.

Further the present invention is a method for producing a rectangular insulated wire, in which a rectangular conductor is coated with an insulating film, comprising the following steps (a) to (d), and carrying out all the steps continuously: (a) supplying a round wire conductor while passing through a rolling unit composed of at least one pair of rolling rolls that are capable of freely rotating without a drive mechanism and that the gap between the paired rolling rolls is equal for all the width, thereby forming a rectangular conductor, (b) annealing said rectangular conductor, (c) coating said rectangular conductor with an insulating film, and (d) winding the thus-obtained rectangular insulated wire.

Other and further features and advantages of the invention will appear more fully from the following description, take in connection with the accompanying drawings.

DETAILED DESCRIPTION

Figure 1:
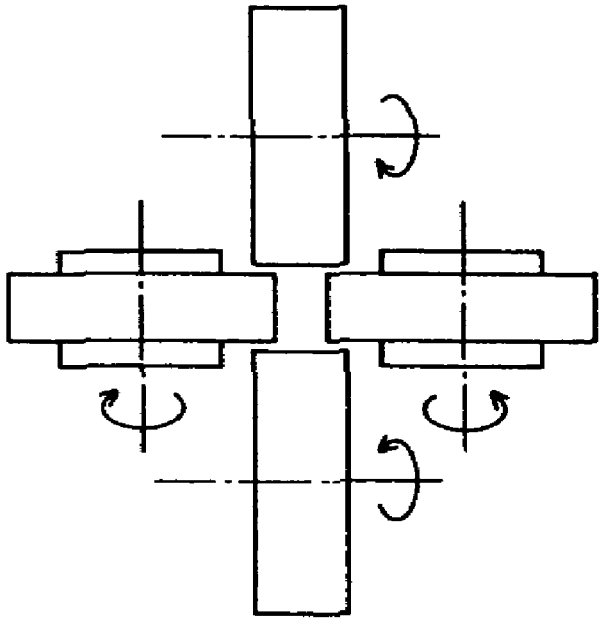
FIG. 1 is a schematic view showing four-direction rolling rolls (two pairs of rolling rolls).

As a result of intensive studies in view of the above problems in the conventional method, the present inventors have found that the problems can be solved by supplying a raw conductor, by rolling-rolls capable of freely rotating without a drive mechanism, to roll the raw conductor, and continuously carrying out all steps, including the rolling step, followed by a step of coating the resultant conductor with an insulating film. The present invention has been attained based on this finding.

According to the present invention there is provided the following means:

(1) A method for producing an insulated wire having a cross section of a desired shape, in which a conductor having a cross section of a desired shape is coated with an insulating film, comprising the steps of:

supplying a raw conductor while passing through a rolling unit composed of at least one pair of rolling rolls that are capable of freely rotating without a drive mechanism and that have a desired shape, thereby forming a conductor having a cross section of a desired shape, and coating the conductor with an insulating film;

(2) The method according to the above (1), wherein said supplying step is carried out by winding said rolled conductor around a capstan with a drive mechanism provided at a rear position of said rolling unit, to give tensile force to the conductor;

(3) The method according to the above (1), wherein said rolled conductor is passed through a drawing die;

(4) The method according to the above (3), wherein said drawing die is provided at any one of or both front and rear positions of the capstan with a drive mechanism;

(5)-The method according to the above (1) or (2), wherein said rolling unit is composed of four-direction rolls;

(6) The method according to the above (3), wherein the raw conductor is simultaneously rolled by four-direction rolls in both the thickness and width directions, and the resultant conductor is drawn by the drawing die;

(7) The method according to the above (1) or (2), wherein said rolling unit is composed of two-direction rolls;

(8) The method according to the above (3), wherein the raw conductor is rolled by two-direction rolls in the thickness direction, and the resultant conductor is drawn by the drawing die;

(9) The method according to the above (1), wherein said conductor is passed through the rolling unit comprising a plurality of rolls composed of two-direction rolls and/or four-direction rolls;

(10) The method according to the above (1), wherein said coating with the insulating film is carried out by enameling (coating and curing an enamel) said insulating film;

(11) The method according to the above (1), wherein said coating with the insulating film is carried out by extrusion-coating an insulating resin;

(12) The method for producing a rectangular insulated wire according to the above (1), wherein said conductor having a cross section of a desired shape is a rectangular wire;

(13) The method for producing a rectangular enameled wire according to the above (10), wherein said conductor having a cross section of a desired shape is a rectangular wire;

(14) The method according to the above (1), wherein the shape of the cross section of said raw conductor is round, elliptical or rectangle; and

(15) A method for producing a rectangular insulated wire, in which a rectangular conductor is coated with an insulating film, comprising the following steps (a) to (d), and carrying out all the steps continuously:

(a) supplying a round wire conductor while passing through a rolling unit composed of at least one pair of rolling rolls that are capable of freely rotating without a drive mechanism and that the gap between the paired rolling rolls is equal for all the width, thereby forming a rectangular conductor, (b) annealing said rectangular conductor, (c) coating said rectangular conductor with an insulating film, and (d) winding the thus-obtained rectangular insulated wire.

The raw conductor used in the present invention is generally a conductor whose cross section is round, that is a section when the conductor is cut by a plane perpendicular to the axial direction of said conductor. The material of conductor is a metal, and the cross section of the conductor is not limited to a round shape, but various shapes, such as ellipse, oval, rectangle, or others, may be used. Accordingly, the shape of the raw conductor before fed to the roll-rolling is not particularly limited. The reason why the conductor of a round shape is generally used, is that in case where a reduction working is carried out by rolling, die-drawing or the like from an ingot of a conductor metal or the like, the working is often carried out using the conductor having a cross section of a round shape.

The material of the metal conductor is exemplified by aluminum, silver, copper, and the like. Among these metals, copper is mainly used. In this case, a low-oxygen copper and an oxygen-free copper in addition to pure copper may be particularly preferably used. Specifically, a conductor made of a low-oxygen copper preferably having an oxygen content of 30 ppm or less, more preferably 20 ppm or less, or an oxygen-free copper may be used.

The term "rolling rolls capable of freely rotating" used in the present invention means that when the raw conductor to be rolled is passed through at least one pair of rolls, without any drive mechanism such as an electric motor, the rolls are rotated by the passing of the conductor. In other words, a conductor having a larger outer diameter than the gap between a pair of rolls is drawn while passing it through the pair of rolls, to give tensile force to the conductor. Consequently, the conductor is rolled so as to take a desired shape, during rotation of the rolls. Accordingly, a pair of rolling rolls used in the present invention is capable of freely rotating, without a drive mechanism such as an electric motor. Thus, the rolling rolls used in the present invention do not have any drive mechanism that compels the rolls to rotate. Therefore, the conductor is subjected to rolling in accordance with a wire speed of the conductor to pass. The production speed of an insulation-coated wire as a final product is decisively controlled by the slowest step, namely by the process speed of the rate-determining step, among a plurality of steps necessary to complete the insulation-coated wire from a raw conductor. In the conventional production method of the rectangular insulation-coated wire, the conductor was rolled by a rolling machine in which a drive mechanism such as an electric motor was installed. Consequently, the rolling rate of the conductor inevitably became quite high due to the economical conditions for use of the rolling machine, which resulted the rate of the insulation-coating step that was the rate-determining step could not follow the rolling rate. Therefore, the rolling step and the insulation-coating step could not be united continuously, but they were separated from each other. This is because it is conspicuously uneconomical to operate the rolling machine such that the speed would be reduced to the insulation-coating rate much lower than the rolling rate of the rolling machine. In a preferable embodiment of the present invention, however, the wire speed at which the raw conductor is supplied while passing it through the rolling rolls is automatically adjusted so as to become almost equal to the wire speed at which the conductor is coated with the above-mentioned insulating film. In other words, the present invention automatically synchronizes the wire speed of each of steps with each other. The present invention uses rolling rolls capable of freely rotating without a drive mechanism. As mentioned above, according to the method of the present invention, the rolling rate of the conductor is therefore automatically determined in accordance with a process speed of the rate-determining step, so that all steps can be continued at almost the same wire speed.

Figure 2:
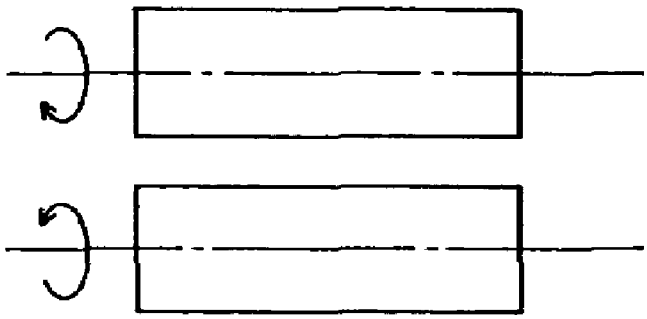
FIG. 2 is a schematic view showing two-direction rolling rolls (one pair of rolling rolls).

In case where a conductor is worked to the shape of rectangular, the rolling rolls are shaped so that the cross section of a plane including the roll axis is in almost parallel with each other between rolls disposed face to face. For example, the shape of the rolling rolls is not particularly limited, so long as they are four-direction or two-direction rolling rolls, as shown in FIG. 1 or FIG. 2. Further, in case where a cross section of the conductor is worked to the shape of an ellipse, rolls disposed face to face with each other are curved towards the roll axis. In case where a conductor is rolled into a wire of another desired shape, the rolls in shape according to the desired shape may be used.

As mentioned above, the present invention uses rolling rolls without any drive mechanism. Accordingly, in case where a conductor to be used in the present invention is pure copper, reduction by the pair of rolls is preferably in the range of 5 to 30%, most preferably in the range of 10 to 25%, from the viewpoints of both prevention of a wire from breaking and dimensional stability of the finished shape after completion of rolling. If the reduction is desired to increase as a whole, the conductor is preferably passed through a plurality of rolling units in succession.

Further, in the present invention, the rolled conductor may be wound around a capstan with a drive mechanism, which capstan is provided at the rear position of the rolling unit, to give tensile force to the conductor. The force to the conductor may be properly adjusted in accordance with a size and a material of the conductor.

In the present invention, it is preferable for improvement in dimensional accuracy of the conductor to use a drawing die after rolling. The drawing die is preferably a widely used diamond die or the like in view of precision and life. The hole shape of the diamond die may be selected such that conductors having a cross section of a desired shape can be obtained in addition to those having a cross section of a rectangular shape. Further, in the case of the drawing die similar to the case of the rolling rolls, when the conductor is made of pure copper, the reduction is preferably in the range of 5 to 30%, most preferably in the range of 10 to 25%, from the viewpoints of both prevention of a wire from breaking and prevention of the drawing die from suffering a short life. The drawing die may be provided at any one of or both of front and rear positions of the capstan with a drive mechanism.

Further, in case where the conductor after completion of these roll-rolling step and die-drawing step may be subjected to work-hardening, if necessary, and generally the conductor after the hardening step is annealed by an annealer disposed in tandem and consecutively enters the insulation-coating step.

The insulation-coating material that can be used in the present invention may be exemplified by polyolefin-series resins, such as polyethylene resins, polypropylene resins, ethylene-series copolymers in which at least one monomer component is ethylene, and propylene-series copolymers in which at least one monomer component is propylene; vinyl chloride resins, and fluororesins. Further, use can be also made of known resins, such as condensed-series resins excellent in thermal resistance, including polyester resins, polyamide resins, polyimide resins, polyamideimide resins, polyetherimide resins, polysulfone resins and polyethersulfone resins. Of these, particularly preferred to be used are resins containing imide bonds having many aromatic rings introduced therein (e.g. polyimides, polyamideimides, polyesterimides), which are excellent in thermal resistance, abrasion resistance and chemical stability.

The insulation-coating method that can be used in the present invention is not particularly limited. Generally, as a coating-forming method, an enameling (coating and curing the enamel), or a coating method in which a resin is extruded on a conductor according to an extrusion-molding method, may be properly used. In the present invention, use can be preferably made of any one of the above methods, which specifically can realize substantial reduction in the number of the steps necessary for production, and which can produce products excellent in important characteristics such as electrical properties.

According to the present invention, a raw conductor is rolled by means of rolling rolls that are capable of freely rotating without a drive mechanism. Consequently, the present invention has realized production of an insulated wire, which enables to continuously carry out all steps starting from feeding of the raw conductor, roll-rolling, coating with an insulating film, and the like, and ending to completion of the insulated wire having a cross section of a desired shape such as rectangular. This enables to produce a high quality insulated wire at much lower cost than the conventional method. Further in the quality aspect, a dimensional precision of the conductor (thickness, width, R) is excellent, and therefore dimensional stability is high, owing to drawing by means of a drawing die. Further, the surface condition of the conductor is smooth and the conductor is excellent in dielectric breakdown voltage and the like, since drawing is carried out at the last step and neither winding nor feeding is carried out during the production process. Besides, in the cost aspect, the "one step" production enables to reduce a labor cost, a power cost, and the like. Further, reduction of lead time shortens the production period of time per unit length, so that management for the time limit of delivery becomes easy and in addition management for expense can be reduced. In view of the above, it is understood that the present invention is very advantageous for an industrial use.

The present invention is explained in more detail with reference to the following examples, but the invention is not limited to these.

EXAMPLE

Example 1

A round wire conductor having a diameter of 2.5 mm was passed through four-direction rolling-rolls (FIG. 1) capable of freely rotating, which were set with the gap among the rolls 1.6 mm×2.6 mm. Further continuously, the resultant conductor was passed through a diamond die of 1.5 mm×2.5 mm in which a corner radius was 0.4 mm, at a wire speed of 8 m per minute. Further continuously, the resultant conductor was passed through an annealer, to eliminate strain of the conductor occurred at the rolling and drawing steps and to soften the conductor. Further continuously, the resultant conductor was coated thereon with a polyamide-imide enamel (manufactured by Hitachi Chemical Co., Ltd.; trade name: HI 4064) by means of a conventional enamel die, and it was passed through a 6-m effective length enameling oven heated to a oven temperature of 500° C., at a wire speed of 8 m per minute. These coating and curing steps were repeated eight times, to obtain a rectangular insulated wire coated with a 40-μm thickness of insulating film.

Example 2

A round wire conductor having a diameter of 2.0 mm was passed through two-direction rolling-rolls (FIG. 2) capable of freely rotating, which were set with the gap between the rolls 1.4 mm. Further continuously, the resultant conductor was passed through a diamond die of 1.3 mm×2.2 mm in which a corner radius was 0.6 mm, at a wire speed of 8 m per minute. Further continuously, the resultant conductor was passed through an annealer, to eliminate strain of the conductor occurred at the rolling and drawing steps and to soften the conductor. Further continuously, the resultant conductor was coated thereon with a polyesterimide enamel (manufactured by Totoku Toryo Co., Ltd.; trade name: HN 8645) by means of the similar enamel die as above, and it was passed through a 6-m effective length enameling oven heated to a oven temperature of 500° C., at a wire speed of 8 m per minute. These coating and curing steps were repeated ten times, to obtain a rectangular insulated wire coated with a 50-μm thickness of insulating film.

Example 3

A round wire conductor having a diameter of 2.4 mm was passed through two-direction rolling-rolls (FIG. 2) capable of freely rotating, which were set with the gap between the rolls 1.7 mm, and then passed through four-direction rolling-rolls (FIG. 1) capable of freely rotating, which were set with the gap among the rolls 1.5 mm×2.4 mm. Further continuously, the resultant conductor was passed through a diamond die of 1.4 mm×2.3 mm in which a corner radius was 0.5 mm, at a wire speed of 8.5 m per minute. Further continuously, the resultant conductor was passed through an annealer, to eliminate strain of the conductor occurred at the rolling and drawing steps and to soften the conductor. Further continuously, the resultant conductor was coated thereon with a polyester enamel (manufactured by Totoku Toryo Co., Ltd.; trade name: L3340) by means of the similar enamel die as above, and it was passed through a 6-m effective length enameling oven heated to a oven temperature of 550° C., at a wire speed of 8.5 m per minute. These coating and curing steps were repeated six times, to obtain a rectangular insulated wire coated with a 30-μm thickness of insulating film.

Example 4

A round wire conductor having a diameter of 2.5 mm was passed through four-direction rolling-rolls (FIG. 1) capable of freely rotating, which were set with the gap among the rolls 1.6 mm×2.6 mm. Further continuously, the resultant conductor was passed through a diamond die of 1.5 mm×2.5 mm in which a corner radius was 0.4 mm, at a wire speed of 15 m per minute. Further continuously, the resultant conductor was passed through an annealer, to eliminate strain of the conductor occurred at the rolling and drawing steps and to soften the conductor. Further continuously, a polyethersulfone resin (manufactured by Sumitomo Chemical Co., Ltd.; trade name: PES 4100) was extruded onto the resultant conductor, by means of a 30-mm diameter of extruder, according to a tube extruding method, at cylinder temperatures of 300° C. (inlet) and 360° C. (outlet), a head temperature of 370° C. and a die temperature of 370° C., at a wire speed of 15 m per minute, to obtain an insulated wire coated with a 45-μm thickness of insulating film.

In each of these examples, microscopic observation of the cross section of the rectangular conductor passed through the diamond die revealed that the corner portion thereof was smooth.

Characteristics of the wires obtained in these examples according to the present invention are shown in Table 1.

COMPARATIVE EXAMPLE

A round wire conductor having a diameter of 2.5 mm was passed through rolls which were set with the gap of rolls 1.5 mm by using a driving-type rolling mill (manufactured by the Torrington Company, a three-step rolling mill), and further the width of the resultant rectangular conductor was regulated by passing through edger rolls with 1.5 mm width and a corner radius of 0.4 mm. Thereafter, the thickness of the conductor was regulated to 1.5 mm by finishing rolls. Then, the thus-finished conductor was wound around a bobbin at a wire speed of 300 m per minute, to obtain a rectangular conductor. The microscopic observation of the cross section of the rectangular conductor revealed that the corner portion thereof was not smooth.

The bobbin around which the rectangular conductor was wound, was placed in a 6-m effective length enameling oven equipped with an annealer. By means of the similar enamel die as in Example 1, a polyamideimide enamel (manufactured by Hitachi Chemical Co., Ltd.; trade name: HI 4064) was coated and cured onto the conductor, while passing the conductor through the enameling oven at a wire speed of 8 m per minute, in the same manner as in Example 1. The above-mentioned coating and curing steps were repeated eight times, to obtain a rectangular insulated wire having a 40-μm thickness of film.

Characteristics of the thus-obtained insulated wire for comparison are also shown in Table 1.

TABLE 1

| | Characteristics of rectangular insulated wires | | | | | |
|---|---|---|---|---|---|---|
| | Example 1 | Example 2 | Example 3 | Example 4 | Comparative Example | Test method |
| Conductor size (mm) thickness × width | 1.501 × 2.502 | 1.298 × 2.201 | 1.401 × 2.301 | 1.500 × 2.503 | 1.501 × 2.505 | JISC3003 |
| Film thickness (mm) thickness × width | 0.040 × 0.042 | 0.048 × 0.051 | 0.032 × 0.031 | 0.045 × 0.046 | 0.041 × 0.040 | JISC3003 |
| Pinhole | 0 | 0 | 0 | 0 | 1 | JISC3003 |
| Dielectric breakdown voltage (kV) | 7.5 | 8.9 | 6.7 | 6.3 | 4.2 | JISC3003 |
| Flexibility flat-wise bending | 1 dF | 1 dF | 1 dF | 1 dF | 2 dF | JISC3003 |
| Outer appearance | Good | Good | Good | Good | Slightly rough | JISC3003 |

Having described our invention as related to the present embodiments, it is our intention that the invention not be limited by any of the details of the description, unless otherwise specified, but rather be construed broadly within its spirit and scope as set out in the accompanying claims.

What is claimed is:

1. A method for producing an insulated wire having a cross section of a desired shape, in which a conductor having a cross section of a desired shape is coated with an insulating film, comprising the steps of:

supplying a raw conductor while passing through a rolling unit composed of at least one pair of rolling rolls that are capable of freely rotating without a drive mechanism that have a desired shape, thereby forming a conductor having a cross section of a desired shape;

annealing said conductor by routing said conductor through an annealer;

coating the conductor with an insulating film by routing the conductor having the cross section of the desired shape through a coating apparatus; and wherein the insulated wire having the cross section of the desired shape is produced in a continuous manner from an uninsulated wire stock without interrupting the production process to store partially produced wire for a period of time prior to routing the wire to the next step in the production process.

2. The method according to claim 1, wherein said supplying step is carried out by winding said rolled conductor around a capstan with a drive mechanism provide at a rear position of said rolling unit, to give tensile force to the conductor.

3. The method according to claim 1, wherein said rolled conductor is passed through a drawing die.

4. The method according to claim 3, wherein the raw conductor is rolled by two-direction rolls in the thickness direction, and the resultant conductor is drawn by the drawing die.

5. The method according to claim 3, wherein said drawing die is provided at any one of or both front and rear positions of the capstan with a drive mechanism.

6. The method according to claim 1, wherein said rolling unit is composed of two-direction rolls (one pair of rolling rolls).

7. The method according to claim 1, wherein said conductor is passed through the rolling unit comprising a plurality of rolls composed of two-direction rolls and/or four-direction rolls.

8. The method according to claim 1, wherein said coating with the insulating film is carried out by coating and curing said insulating film.

9. The method according to claim 8, wherein said conductor having a cross section of a desired shape is a rectangular wire.

10. The method according to claim 1, where said coating with the insulating film is carried out by extrusion-coating an insulating resin.

11. The method according to claim 1, wherein said conductor having a cross section of a desired shape is a rectangular wire.

12. The method according to claim 1, wherein the shape of the cross section of said raw conductor is round, elliptical or rectangle.

* * * * *